US008376321B2

(12) United States Patent
Dotsey

(10) Patent No.: US 8,376,321 B2
(45) Date of Patent: Feb. 19, 2013

(54) RAIL ASSEMBLY HAVING A BALUSTER SWING BRACKET

(75) Inventor: Michael Dotsey, Pottstown, PA (US)

(73) Assignee: AZEK Building Products, Inc., Scranton, PA (US)

( * ) Notice: Subject to any disclaimer, the term of this patent is extended or adjusted under 35 U.S.C. 154(b) by 277 days.

(21) Appl. No.: 12/836,685

(22) Filed: Jul. 15, 2010

(65) Prior Publication Data

US 2012/0012802 A1 Jan. 19, 2012

(51) Int. Cl.
*E04H 17/00* (2006.01)

(52) U.S. Cl. ..... 256/65.07; 256/22; 256/65.03; 256/65.08

(58) Field of Classification Search ..... 256/19, 256/22, 59, 65, 65.03, 65.07, 65.08, 66, 68, 256/69; 248/261, 316.8
See application file for complete search history.

(56) References Cited

U.S. PATENT DOCUMENTS

| | | | | | |
|---|---|---|---|---|---|
| 2,754,092 | A | * | 7/1956 | Cremens | 256/21 |
| 2,855,227 | A | * | 10/1958 | Bottom | 403/119 |
| 3,004,751 | A | | 10/1961 | Woodward | |
| 3,174,727 | A | | 3/1965 | Burt | |
| 3,258,251 | A | * | 6/1966 | Culter | 256/22 |
| 3,498,589 | A | * | 3/1970 | Murdock | 256/70 |
| 3,596,880 | A | * | 8/1971 | Greenberg | 256/65.1 |
| 3,620,505 | A | * | 11/1971 | Murdock | 256/70 |
| 3,955,800 | A | * | 5/1976 | Russo | 256/59 |
| 4,050,828 | A | * | 9/1977 | Noro | 403/201 |
| 4,193,585 | A | * | 3/1980 | Eandi | 256/65.07 |
| 4,280,686 | A | * | 7/1981 | Wack | 256/65.07 |
| 4,344,604 | A | | 8/1982 | Basey | |
| 4,352,485 | A | | 10/1982 | Basey | |
| 4,421,302 | A | * | 12/1983 | Grimm et al. | 256/67 |
| 4,509,881 | A | | 4/1985 | Welch | |
| 4,533,121 | A | | 8/1985 | Basey | |
| 4,711,593 | A | * | 12/1987 | Wilhelmi | 403/187 |
| 4,886,245 | A | | 12/1989 | Manzo | |
| 4,898,365 | A | * | 2/1990 | Conner et al. | 256/65.12 |
| 5,056,283 | A | | 10/1991 | Sapinski | |
| 5,340,087 | A | | 8/1994 | Turner | |
| 5,544,866 | A | * | 8/1996 | Dye | 256/69 |
| 5,557,893 | A | * | 9/1996 | Bowls | 52/187 |
| 6,305,670 | B1 | * | 10/2001 | Ward et al. | 256/59 |
| 7,077,386 | B1 | * | 7/2006 | Gray et al. | 256/67 |
| 7,571,897 | B2 | * | 8/2009 | Heinz | 256/65.03 |
| 7,621,510 | B2 | * | 11/2009 | Gibbs et al. | 256/22 |
| 7,992,841 | B2 | * | 8/2011 | Petta et al. | 256/65.07 |
| 2004/0188666 | A1 | * | 9/2004 | Pratt | 256/65.07 |

* cited by examiner

*Primary Examiner* — Michael P Ferguson
*Assistant Examiner* — Nahid Amiri
(74) *Attorney, Agent, or Firm* — Buchanan Ingersoll & Rooney PC

(57) ABSTRACT

A rail system has a baluster swing bracket configured to attach a baluster to the underside of a railing. This bracket has a flat body attached to the baluster and a flange offset from the flat body and attached to the railing, creating a gap between the railing and the baluster. This gap enables the baluster to be positioned close to the vertical surface to which the end of the railing is attached because a portion of the fastener connecting the railing to the vertical surface may be within the gap. The flange may be loosened or disconnected from the railing without removing the baluster swing bracket from the baluster. Disconnecting the flange allows the baluster to rotate or swing under the railing. Loosening the flange allows the baluster to rotate outward from the railing.

9 Claims, 3 Drawing Sheets

RAIL ASSEMBLY HAVING A BALUSTER SWING BRACKET

FIELD OF THE INVENTION

The present invention relates generally to the field of construction assemblies. More specifically, the invention relates to the field of railing assemblies with balusters for staircases, ramps, and the like, and connectors used to attach the balusters to the rail.

BACKGROUND OF THE INVENTION

Boundary systems are commonly used in conjunction with staircases, ramps, or the like to prevent people from falling over the edge of these structures. Integral to such boundary systems are rail members parallel to the edge of the staircase or ramp, commonly known in the art as handrails or banisters. Such handrails or banisters may be supported by one or more vertical supports along the length of the handrail or banister, commonly known in the art as a balusters. Such balusters are generally connected to the underside of the handrail or banister. A variety of fasteners have been used to connect the baluster to the underside of the handrail or banister.

It is sometimes desired to move a baluster relative to the railing after the baluster has been attached to such railing. This may be to permit the baluster and railing to be assembled off-site and subsequently installed as one unit on-site. In such situations the ability of the balusters to move relative to the railing may permit the baluster and the railing to adapt to a variety of pitch angles. Examples of such boundary systems may be appreciated from U.S. Pat. Nos. 5,340,087, 5,056,283, and 4,886,245. Such systems may include a series of balusters that extend from the railing to a base. Each support may have a connector or connectors that allow the installer to adjust the angle between the baluster and the railing to a desired pitch angle.

Many systems allow the movement of all associated balusters in concert. The balusters remain parallel at all times because of their connection to the rail member and a second lower rail, known in the art as a shoe rail. Pivoting such balusters necessarily requires movement of the handrail or the shoe rail. Typically, the connections between the balusters and the railings are not meant to be disconnected. Due to the nature of the pivoting connectors, these balusters may be difficult or impossible to remove.

If it is desired to perform some manner of work on the vertical surface to which the railing is attached, a baluster close to the vertical surface may be a hindrance to such work. Attempts to pivot the baluster away from the vertical surface may be frustrated by the necessity of all balusters pivoting together with the railing to which they are attached. Such movement of the balusters may not even be possible when the work to be performed involves connecting the railing to the vertical surface in the first place. Because the railing must be placed in a desired position, the balusters are necessarily prevented from pivoting during the connection of the railing to the vertical surface. Such work would prevent the railing from moving away from the vertical surface, preventing the balusters from moving at all.

In such situations, it may be desirable to tilt a single baluster out of the way or remove it entirely for the duration of the work to be performed. Typically, removing a single baluster can be difficult or time consuming, especially for one not skilled in carpentry or the like. Such difficulty may be compounded if the baluster is connected by one of the pivoting joints as described above, because such pivoting balusters cannot be pivoted one at a time.

U.S. Pat. No. 4,509,881 describes a mechanism which detachably secures a spindle post in place by using two bases for receiving the post, one of the bases being spring loaded. The spindle post may be inserted into the spring loaded base at an angle, depressing the spring until the spindle post may be rotated into alignment with the other base such that the spring may push the spindle post into the second base, securing the spindle post in place between the two bases.

Installing a spindle post as described in U.S. Pat. No. 4,509,881 involves a complicated and expensive mechanism. The two required bases are not identical, and the spring loaded base may have multiple parts which increases its construction costs. It may take considerable strength to insert or remove such a spindle post into or out from the spring loaded base. Such bases are necessarily larger than the diameter of the spindle posts, and may not be aesthetically pleasing in conjunction with a handrail or banister. Finally, there is a danger of marring the surface or the finish of the spindle post when inserting it into or removing it from the bases because of the forces applied to the spindle post and the angles necessary to pivot it into place.

It is typically desired that the balusters supporting a handrail or banister be positioned and evenly spaced along the length of the handrail or banister for aesthetic purposes. When a connector is used to attach the railing to a vertical surface, the baluster closest to the vertical surface may at least partially interfere with such connector. To maintain the desired aesthetic effect of spacing the balusters along the railing, the baluster nearest the connector may need to be modified, by for example cutting a notch or opening into the top of the baluster in which the connector may at least partially fit.

Modification of a single baluster to permit a connector to be at least partially positioned therein may be difficult for a homeowner or other person unskilled in carpentry or the like to perform. The modification is a time consuming process even for a skilled carpenter. Furthermore, the bases which detachably secure a spindle post in place as described in U.S. Pat. No. 4,509,881 may be difficult or impossible to modify to allow a connector to be positioned at least partially within the bases. Such a modification may weaken or deform the base so that it may not be able to secure the spindle post in place properly. In any case, such a modification may be beyond the purview of a homeowner or other person unskilled in carpentry or the like.

A new, simple, and inexpensive connector for connecting a baluster to a railing is needed which permits a separate connector to be at least partially positioned above the baluster while providing for swinging the baluster away from a nearby vertical surface to allow a worker greater access to the vertical surface under the railing. Such a connector should permit these goals in a manner easy enough to be employed by a homeowner or other person having limited carpentry skills.

SUMMARY OF THE INVENTION

An improved rail system having a rail member and a plurality of balusters is provided in which the improvement is a baluster swing bracket connecting the baluster to the underside of the rail member. The baluster swing bracket has a flat body, a tab extending from the flat body, and a flange extending from the tab. The flange is substantially parallel to the flat body. The flat body is attached to the top of the baluster so that the tab extends away from the baluster. The flange is attached to the underside of the rail member.

The flat body of the baluster swing bracket may have a center with an aperture and the baluster swing bracket may be attached to the top of the baluster by a fastener passing through the aperture. The flat body may be sized and configured to mate with and conform to the top of the baluster. The tab may make a substantially ninety degree angle with the flat body, and the tab may extend from an end of the flat body.

The flange may have a center with an axis passing through the center at a ninety degree angle to the flange. The flange may have an aperture in the center and the flange may be attached to the underside of the railing by a fastener passing through the aperture.

The flat body, the tab, and the flange may be an integrally formed unit. At least one of the flat body, the tab, or the flange may be made of aluminum, iron, brass, steel, stainless steel, or other metal alloy. The tab creates a gap between the underside of the rail member and the flat body of the baluster swing bracket. A second connector attached to the underside of the railing may be at least partially positioned within the gap. The gap may be covered by a cap fitting over the rail member.

The flange may be released from the underside of the railing by for example removing the fastener passing through the aperture of the flange. The baluster may then rotate away from or swing below the railing while the baluster swing bracket stays attached to the baluster. The baluster may then be rotated or swing back into position and the flange attached to the underside of the railing.

The fastener passing though the flange may be loosened, allowing the flange, the baluster swing bracket, and the baluster being still connected to the baluster swing bracket to pivot along the axis through the flange. This permits the baluster to rotate out from under the railing while remaining vertical. The baluster may then be rotated back into position and the fastener through the flange tightened.

Other details, objects, and advantages of the invention will become apparent as the following description of certain present preferred embodiments thereof and certain preferred methods of practicing the same proceeds.

BRIEF DESCRIPTION OF THE DRAWINGS

Present preferred embodiments of my universal handrail support bracket are shown in the accompanying drawings, and certain present preferred methods of practicing the same are also illustrated therein.

DESCRIPTION OF PRESENTLY PREFERRED EMBODIMENTS

Figure 1:
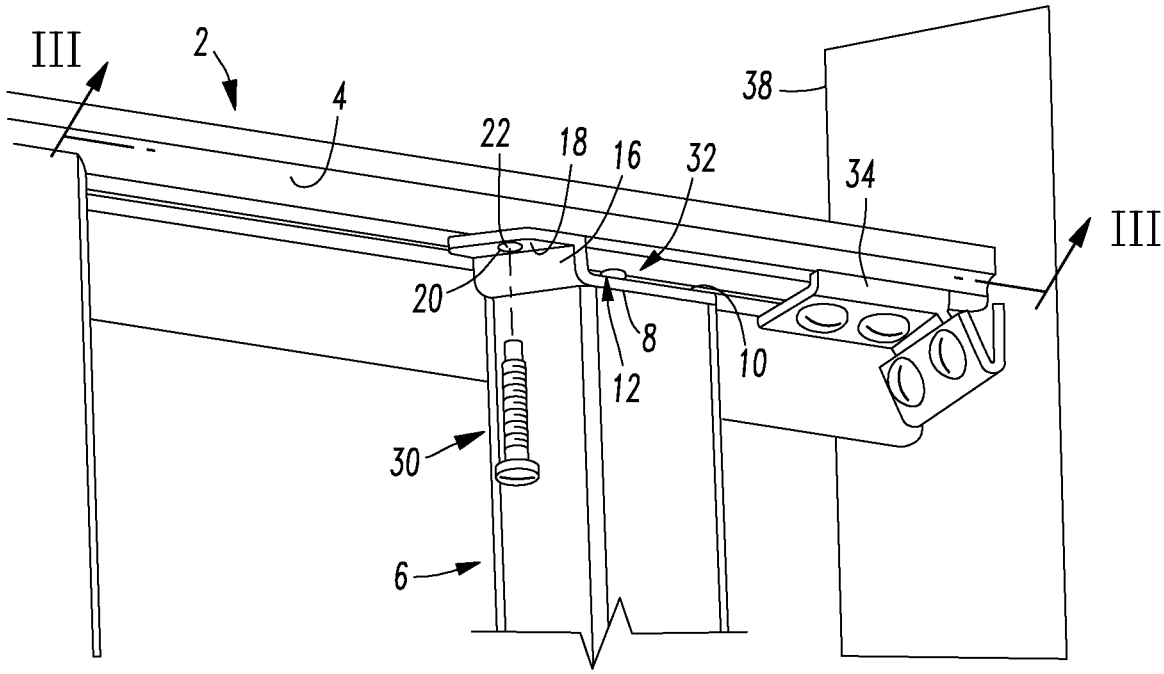
FIG. 1 is a perspective view of a first presently preferred baluster swing bracket and baluster installed against a rail member.

Referring to FIG. 1, a baluster 6 near a substantially vertical surface 38 may have attached thereto my baluster swing bracket 10. The baluster swing bracket 10 has a flat body 12 and a tab 16 extending from the flat body 12 and connecting to a flange 18. The flat body 12 of the baluster swing bracket 10 connects to the top 8 of the baluster 6. The tab 16 extends away from the baluster 6. The flange 18 connects to the underside 4 of a rail member 2. Preferably the flange 18 has an aperture 22 in the center 20 of the flange 18 for receiving a fastener such as a screw 30 into the underside 4 of the rail member 2.

Figure 2:
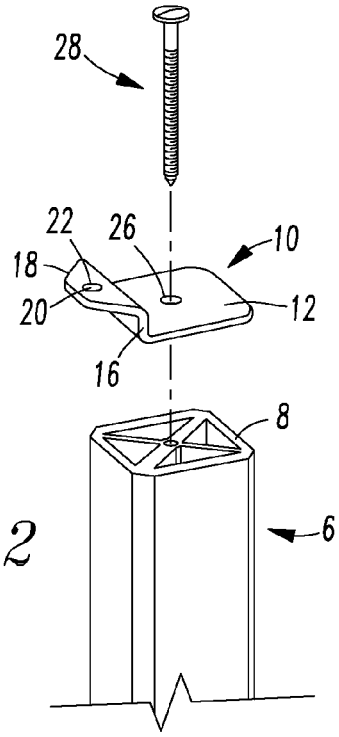
FIG. 2 is an exploded view of the presently preferred embodiment of the baluster swing bracket and a top portion of a baluster to which the baluster swing bracket is attached.

As may be appreciated from FIG. 2, the baluster swing bracket 10 has a flat body 12, a tab 16 extending from the flat body 12, and a flange 18 extending from the tab 16. Preferably the flange 18 and the tab 16 are integral with the flat body 12 of the baluster swing bracket 10 such that the flat body 12, the tab 16, and the flange 18 are a unitary structure.

The flat body 12 is preferably sized and configured to mate with and conform to the top 8 of the baluster 6. Though less preferred, it is also contemplated that the flat body 12 may have other sizes or configurations which are not the same size as the top 8 of the baluster 6. Preferably the flat body 12 has a center aperture 26. The baluster swing bracket 10 is attached to the top 8 of the baluster 6 by for example a fastener such as a screw 28 passing though the aperture 26 of the flat body 12 and into the baluster 6. Although less preferred, it is also contemplated that the flat body 12 may be attached to the top 8 of the baluster 6 via other means, such as for example adhesives like epoxy or glue, a tongue and groove joint, or other fastening mechanisms.

The baluster swing bracket 10 has a tab 16 extending from the flat body 12. Preferably the tab 16 forms a substantially ninety degree angle with the flat body 12 and is connected to the flat body 12 at an end of the flat body 12. Although less preferable, it is also contemplated that the tab 16 may be at an obtuse angle or acute angle with the flat body 12. The tab 16 may be attached to the flat body 12 at a location other than at an end of the flat body 12. When the flat body 12 is attached to the top 8 of the baluster 6, the tab 16 extends away from the top 8 of the baluster 6.

A flange 18 extends from the tab 16. The flange 18 is substantially parallel to the flat body 12. The flange 18 extends away from the flat body 12. Preferably, the flange 18 forms a substantially ninety degree angle with the tab 16. Although less preferable, it is also contemplated that the flange 18 may be at an acute angle or an obtuse angle with the tab 16.

The flange 18 has a center 20 and preferably an aperture 22 located in the center 20. The baluster swing bracket 10 is attached to the underside 4 of the rail member 2 by for example a fastener such as a screw 30 passing though the aperture 22 of the flange 18 and into the underside 4 of the rail member 2. Although less preferred, it is also contemplated that the flange 18 may be attached to the underside 4 of the rail member 2 via other means, such as for example other fastening mechanisms. Preferably the flange 18 extends away from a vertical surface 38 which is connected to the rail member 2 and nearest the baluster 6.

Figure 3:
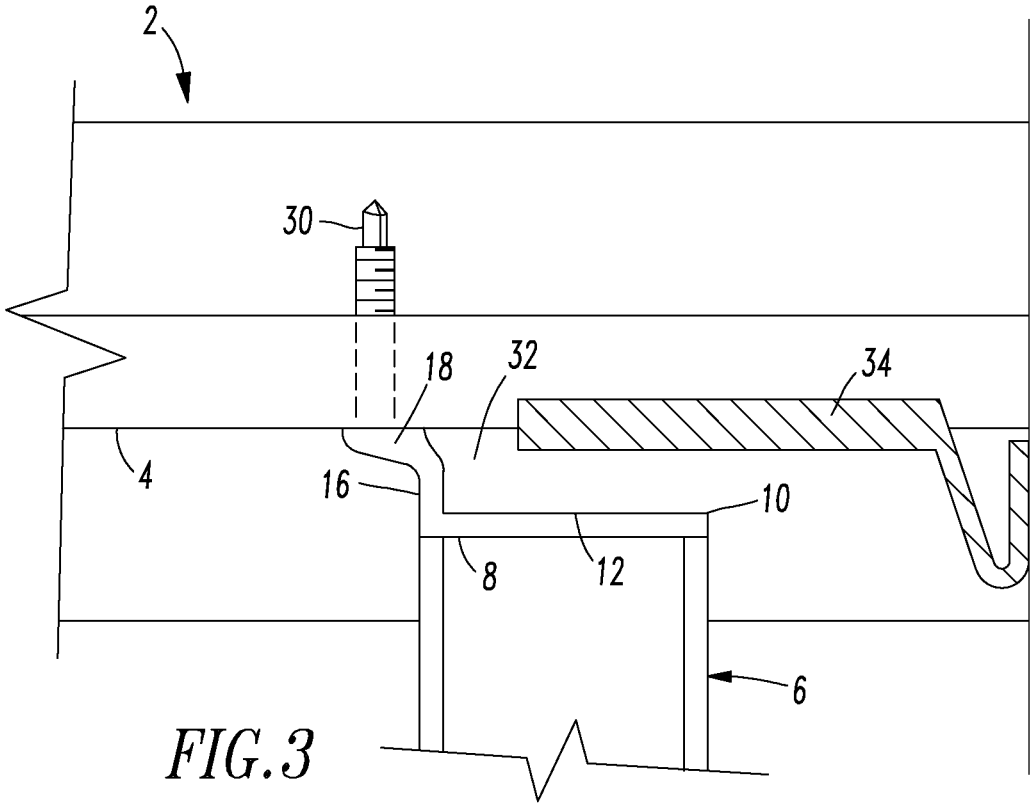
FIG. 3 is a sectional view taken along the line III-III in FIG. 1

Installation of the baluster swing bracket 10 to the baluster 6 and the rail member 2 may be appreciated from FIG. 3. When the baluster 6 is connected by the baluster swing bracket 10 to the underside 4 of the rail member 2, a gap 32 between the underside 4 of the rail member 2 and the flat body 12 of the baluster swing bracket 10 results from the tab 16. The size of the gap is determined by the amount the tab 16 offsets the flange 18 from the flat body 12. Preferably the gap 32 is large enough to allow at least a portion of a second connector 34 also connected to the underside 4 of the rail member 2 to be positioned within the gap 32. Though less preferred, the gap 32 may be of a different size to meet a particular design objective or to provide a desired aesthetic effect. A cap 36 may be placed on the rail member 2 and extend downward to cover the gap 32.

The gap 32 allows the baluster 6 to be positioned close to the vertical surface 38 to which the rail member 2 is attached without cutting or notching the baluster 6. As a result the installer can maintain the same spacing between all adjacent balusters throughout the railing. The gap 32 also permits the baluster 6 to be swung away from the vertical surface 38 to which the rail member 2 is to be attached, providing easier access for the fasteners such as screws in the baluster swing bracket 10. Consequently, the rail member 2 can be installed much faster and more accurately than if the baluster 6 did not move.

At least one of the flat body 12, tab 16, and flange 18 may be made from metal, such as aluminum, iron, brass, steel, stainless steel, or other metal allow. It is contemplated that at least one of the flat body 12, tab 16, and flange 18 may be made from other materials, such as for example polymeric material, ceramic material, or a composite material.

Figure 4:
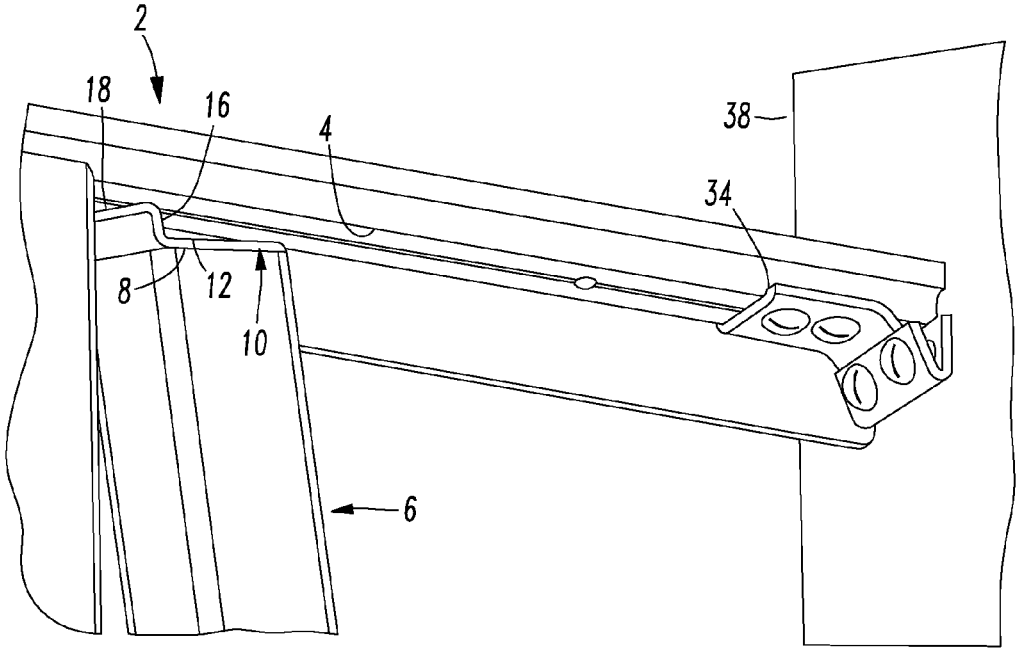
FIG. 4 is a perspective view of a presently preferred baluster swing bracket and baluster assembly showing the baluster moved away from a vertical surface.
Figure 5:
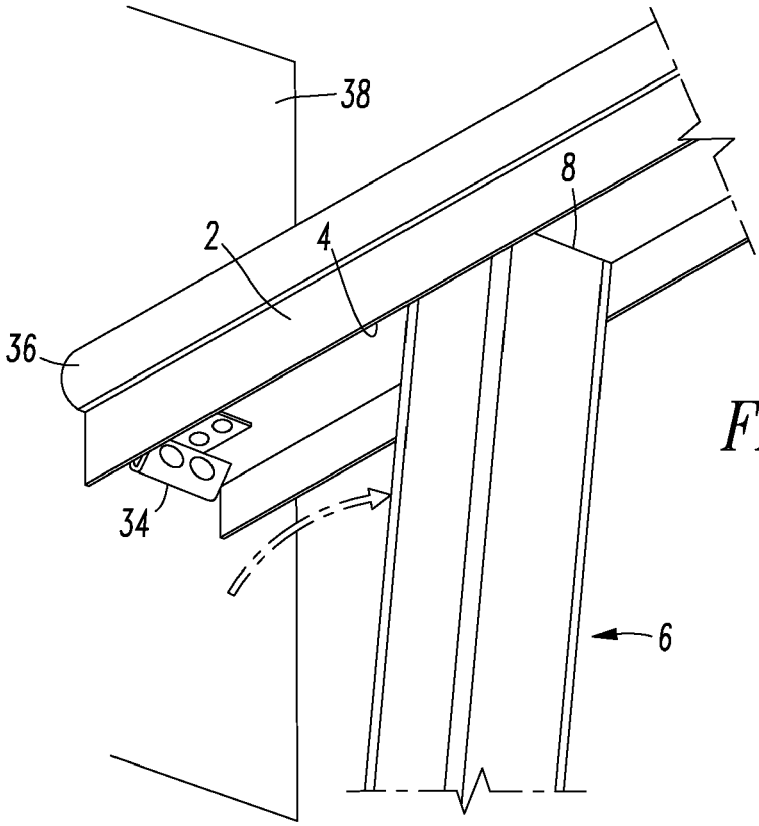
FIG. 5 is a second perspective view of a presently preferred baluster swing bracket and baluster assembly showing the baluster moved away from a vertical surface and a cap on the rail member.

A first preferred manner of using the baluster swing bracket 10 is shown in FIGS. 3-5. After the baluster 6 has been connected via the baluster swing bracket 10 to the underside 4 of the rail member 2, the fastener, such as a screw 30 connecting the flange 18 to the underside 4 of the rail member 2, is removed. If another less preferred fastening mechanism is used to attach the flange 18 to the underside 4 of the rail member 2, it is similarly released to free the flange 18 from the underside 4 of the rail member 2. This permits the baluster 6 with the baluster swing bracket 10 still attached to rotate or swing away from the vertical surface 38 while remaining under the rail member 2, as can be seen most clearly in FIG. 4. If the cap 36 is positioned over the handrail, the baluster 6 may still rotate or swing away from the vertical surface 38 while the cap 36 remains in place.

The baluster 6 may have a bottom which is connected to the ground or a shoe rail (not shown). Such a connection may be made by a screw, bolt, or other fastener. If the bottom of the baluster 6 is so connected to the ground or a shoe rail, the fastener should be loosened or disconnected to allow the baluster 6 with the baluster swing bracket 10 still attached to rotate or swing away from the vertical surface 38 while remaining under the rail member 2.

Rotating the baluster 6 away in this manner has been found to permit a worker to have greater access to the rail fastening bracket 24 and the vertical surface 38 under the rail member 2 than when the baluster 6 is in place. The baluster 6 with the baluster swing bracket 10 still attached may be repositioned by rotating the baluster 6 back to a desired position, and replacing the fastener such as a screw 30 through the aperture 22 in the flange 18 and into the underside 4 of the rail member 2.

Figure 6:
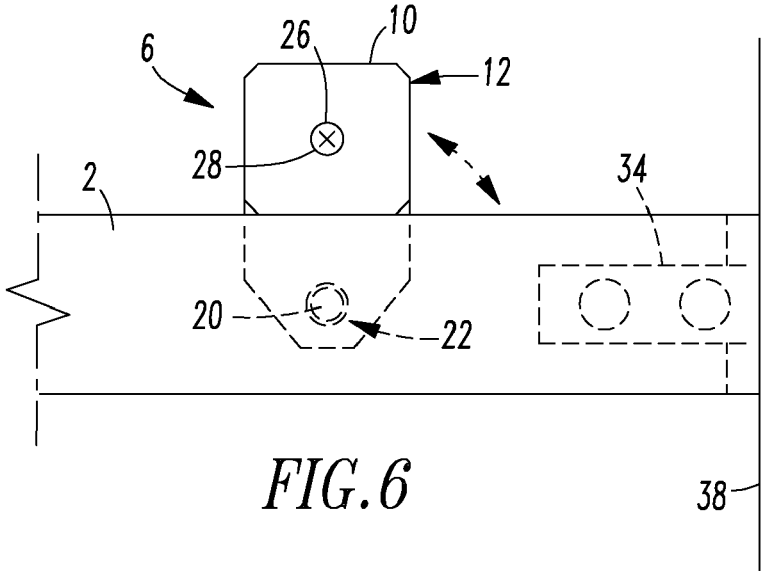
FIG. 6 is a plan view of a second preferred embodiment of the baluster swing bracket assembly pivoting a baluster out from under a rail member.

A second preferred manner of using the baluster swing bracket 10 may be appreciated from FIG. 6. The fastener (not shown) passing through the aperture 22 in the flange 18 is loosened but not removed from the underside 4 of the rail member 2. This may permit the baluster 6 with the baluster swing bracket 10 attached to rotate outward from the rail member 2 while the baluster 6 remains substantially vertical. The baluster 6 with the baluster swing bracket 10 attached rotates around an axis passing through the center 20 of the flange 18.

The baluster 6 may have a bottom which is connected to the ground or a shoe rail (not shown). Such a connection may be made by a screw, bolt, or other fastener. If the bottom of the baluster 6 is so connected to the ground or a shoe rail, the fastener should be loosened or disconnected to allow the baluster 6 with the baluster swing bracket 10 still attached to rotate outward from the rail member 2 while the baluster 6 remains substantially vertical.

Rotating the baluster 6 out from under the rail member 2 in this manner will permit a worker to have greater access to the rail fastening bracket 24 and the vertical surface 38 under the rail member 2 than when the baluster 6 is in place. The baluster 6 with the baluster swing bracket 10 still attached may be repositioned by rotating the baluster 6 back to a desired position, and tightening the fastener (not shown) through the aperture 22 in the flange 18 and into the underside 4 of the rail member 2.

While certain present preferred embodiments of my baluster swing bracket and certain embodiments of practicing and making the same have been shown and described, it is to be distinctly understood that the invention is not limited thereto but may be otherwise variously embodied and practiced within the scope of the following claims.

I claim:

1. A rail system comprising:

a rail member having an underside;

a plurality of balusters and each baluster having a top surface;

a plurality of connectors, one connector attached to each baluster and the plurality of connectors attached to the rail wherein at least one of the connectors is a baluster swing bracket, the baluster swing bracket having a flat body, a tab extending from the flat body, and a flange extending from the tab, the flange extending away from the flat body and being substantially parallel to the flat body;

the flat body of the baluster swing bracket being attached to the top surface of the baluster so that the tab extends outwardly away from the baluster;

the flange of the baluster swing bracket being directly attached to the underside of the rail member such that there is a gap between the underside of the rail member and the flat body; and a second connector attached to the underside of the rail member and having a projection that is within the gap between the underside of the rail member and the flat body of the baluster swing bracket, and further having a body from which the projection extends adapted to be connected to a vertical surface.

2. The rail system as claimed in claim 1 wherein the flat body of the baluster swing bracket has a center with an aperture and the baluster swing bracket is attached to the top surface of the baluster by a fastener passing through the aperture.

3. The rail system as claimed in claim 1 wherein the flange has a center with an aperture and the flange is directly attached to the underside of the rail member by a fastener passing through the aperture.

4. The rail system as claimed in claim 3 wherein the center of the flange has an axis at a substantially ninety degree angle to the flange, and the fastener into the underside of the rail member is capable of being loosened to permit the baluster to rotate around the axis.

5. The rail system as claimed in claim 1 wherein the flat body of the baluster swing bracket is sized and configured to mate with and conform to the top of the baluster.

6. The rail system as claimed in claim 1 wherein the tab makes a substantially ninety degree angle with the flat body of the baluster swing bracket.

7. The rail system as claimed in claim 1 wherein the flat body of the baluster swing bracket, the tab, and the flange are an integrally formed unit.

8. The rail system as claimed in claim 1 wherein the baluster swing bracket is made of a metal selected from the group consisting of aluminum, iron, brass, steel, or stainless steel.

9. The rail system as claimed in claim 1 also comprising a cap on the rail member, a portion of the cap covering the gap between the underside of the rail member and the flat body of the baluster swing bracket.

* * * * *